US007900374B2

(12) United States Patent
Bae et al.

(10) Patent No.: US 7,900,374 B2
(45) Date of Patent: Mar. 8, 2011

(54) APPARATUS FOR AUTOMATICALLY DRYING AND METHOD FOR CONTROLLING THE SAME

(75) Inventors: Sun Cheol Bae, Masan-si (KR); Dae Woong Kim, Changwon-Si (KR); Chang Woo Son, Busan (KR)

(73) Assignee: LG Electronics Inc., Seoul (KR)

( * ) Notice: Subject to any disclaimer, the term of this patent is extended or adjusted under 35 U.S.C. 154(b) by 732 days.

(21) Appl. No.: 11/660,210

(22) PCT Filed: Aug. 18, 2004

(86) PCT No.: PCT/KR2004/002075
§ 371 (c)(1),
(2), (4) Date: Jul. 1, 2007

(87) PCT Pub. No.: WO2006/019201
PCT Pub. Date: Feb. 23, 2006

(65) Prior Publication Data

US 2007/0271814 A1 Nov. 29, 2007

(51) Int. Cl.
*F26B 19/00* (2006.01)

(52) U.S. Cl. ..... 34/491; 34/550; 34/562; 34/572; 702/24; 340/905; 340/359.13; 73/25.03; 204/431; 359/237; 359/900

(58) Field of Classification Search ..... 34/491, 34/550, 562, 572; 340/905, 359.1; 359/237, 359/900; 73/25.03; 702/24; 204/431
See application file for complete search history.

(56) References Cited

U.S. PATENT DOCUMENTS

| | | | | | |
|---|---|---|---|---|---|
| 1,997,826 | A | * | 4/1935 | Krick | 34/475 |
| 3,071,864 | A | * | 1/1963 | Menk | 34/527 |
| 3,986,268 | A | * | 10/1976 | Koppelman | 34/257 |
| 4,206,552 | A | * | 6/1980 | Pomerantz et al. | 34/445 |
| 4,333,490 | A | * | 6/1982 | Enter, Sr. | 137/78.3 |
| 4,435,194 | A | * | 3/1984 | Picard et al. | 95/19 |
| 4,481,786 | A | * | 11/1984 | Bashark | 62/160 |
| 4,485,566 | A | * | 12/1984 | Vivares | 34/547 |
| 4,509,505 | A | * | 4/1985 | Mercey et al. | 600/22 |
| 4,607,408 | A | * | 8/1986 | Didier et al. | 8/159 |
| 4,649,654 | A | * | 3/1987 | Hikino et al. | 34/493 |
| 4,733,479 | A | * | 3/1988 | Kaji et al. | 34/446 |
| 4,738,034 | A | * | 4/1988 | Muramatsu et al. | 34/524 |
| 4,820,377 | A | * | 4/1989 | Davis et al. | 134/1.1 |
| 4,835,991 | A | * | 6/1989 | Knoop et al. | 68/12.19 |
| 4,843,867 | A | * | 7/1989 | Cummings | 73/29.03 |

(Continued)

FOREIGN PATENT DOCUMENTS

JP 56070449 A * 6/1981

(Continued)

*Primary Examiner* — Stephen M. Gravini
(74) *Attorney, Agent, or Firm* — KED & Associates LLP

(57) ABSTRACT

An automatic drying apparatus and a method of controlling the same is disclosed, enabling exact drying by using a humidity sensor (37) provided at a location having a stabilized output characteristic for automatic drying, the automatic drying apparatus including a heating apparatus (31) for heating air supplied into a drum into which a drying object is introduced, a fan (32) for forcibly drawing air into the drum; and a humidity sensor (37) provided between the fan (32) and the heating apparatus (37) such that a sensing surface is positioned to be parallel to a flowing direction of air passed through the fan (32), for outputting a sensing voltage value for determining dryness of the drying object.

10 Claims, 14 Drawing Sheets

U.S. PATENT DOCUMENTS 4,862,710 A * 9/1989 Torita et al. ..... 68/12.01
4,877,757 A * 10/1989 York et al. ..... 438/767
4,898,713 A * 2/1990 Picard ..... 422/3
4,904,621 A * 2/1990 Loewenstein et al. ..... 134/1.2
4,909,999 A * 3/1990 Cummings et al. ..... 422/298
4,956,145 A * 9/1990 Cummings et al. ..... 422/28
4,992,247 A * 2/1991 Foti ..... 422/304
5,042,276 A * 8/1991 Kamano et al. ..... 68/12.04
5,050,313 A * 9/1991 Wakaeya et al. ..... 34/454
5,161,314 A * 11/1992 Souza ..... 34/493
5,161,393 A * 11/1992 Payne et al. ..... 68/12.04
5,172,490 A * 12/1992 Tatsumi et al. ..... 34/488
5,173,258 A * 12/1992 Childers ..... 422/27
5,207,764 A * 5/1993 Akabane et al. ..... 68/20
5,208,931 A * 5/1993 Williams et al. ..... 8/159
5,230,228 A * 7/1993 Nakano et al. ..... 68/12.04
5,233,847 A * 8/1993 Tanaka ..... 68/12.04
5,240,177 A * 8/1993 Muramatsu et al. ..... 236/44 C
5,241,845 A * 9/1993 Ishibashi et al. ..... 68/12.02
5,258,162 A * 11/1993 Andersson et al. ..... 422/28
5,284,523 A * 2/1994 Badami et al. ..... 134/18
5,291,626 A * 3/1994 Molnar et al. ..... 8/158
5,313,964 A * 5/1994 Dausch et al. ..... 134/57 D
5,330,580 A * 7/1994 Whipple et al. ..... 134/18
5,347,727 A * 9/1994 Kim ..... 34/491
5,445,792 A * 8/1995 Rickloff et al. ..... 422/28
5,508,009 A * 4/1996 Rickloff et al. ..... 422/292
5,560,124 A * 10/1996 Hart et al. ..... 34/493
5,570,520 A * 11/1996 Huffington ..... 34/535
5,577,283 A * 11/1996 Badami et al. ..... 8/158
5,600,310 A * 2/1997 Whipple et al. ..... 340/3.51
5,600,961 A * 2/1997 Whipple, III ..... 62/175
5,647,231 A * 7/1997 Payne et al. ..... 68/12.01
5,649,372 A * 7/1997 Souza ..... 34/491
5,659,972 A * 8/1997 Min et al. ..... 34/255
5,669,095 A * 9/1997 Dausch et al. ..... 8/158
5,669,250 A * 9/1997 Dausch et al. ..... 68/12.02
5,682,684 A * 11/1997 Wentzlaff et al. ..... 34/495
5,813,134 A * 9/1998 Min et al. ..... 34/255
5,899,005 A * 5/1999 Chen et al. ..... 34/528
5,906,794 A * 5/1999 Childers ..... 422/28
5,981,022 A * 11/1999 Min et al. ..... 428/98
6,079,121 A * 6/2000 Khadkikar et al. ..... 34/528
6,122,840 A * 9/2000 Chbat et al. ..... 34/496
6,154,978 A * 12/2000 Slutsky ..... 34/321
6,158,148 A * 12/2000 Krausch ..... 34/497
6,334,267 B1 * 1/2002 Slutsky ..... 34/606
6,405,453 B1 * 6/2002 Salameh et al. ..... 34/491
6,446,357 B2 * 9/2002 Woerdehoff et al. ..... 34/491
6,519,871 B2 * 2/2003 Gardner et al. ..... 34/497
6,546,646 B1 * 4/2003 Thomas ..... 34/412
6,691,536 B2 * 2/2004 Severns et al. ..... 68/12.27
6,751,888 B2 * 6/2004 Lueckenbach ..... 34/595
6,761,109 B2 * 7/2004 Newman et al. ..... 99/516
6,845,290 B1 * 1/2005 Wunderlin et al. ..... 700/208
6,875,399 B2 * 4/2005 McVey ..... 422/3
6,877,724 B1 * 4/2005 Petty et al. ..... 261/30
6,893,469 B1 * 5/2005 Van Hauwermeiren et al. ..... 8/149.1
6,898,951 B2 * 5/2005 Severns et al. ..... 68/5 C
6,936,434 B2 * 8/2005 McDonnell et al. ..... 435/31
6,941,674 B2 * 9/2005 Park et al. ..... 34/88
6,953,549 B2 * 10/2005 Hill et al. ..... 422/30
6,974,126 B2 * 12/2005 Newman et al. ..... 261/78.2
7,008,658 B2 * 3/2006 Newman et al. ..... 426/281
7,013,578 B2 * 3/2006 Wunderlin et al. ..... 34/528
7,014,813 B1 * 3/2006 Watling et al. ..... 422/26
7,020,982 B2 * 4/2006 Park et al. ..... 34/496
7,114,209 B2 * 10/2006 Metzger-Groom et al. ..... 8/158
7,132,083 B2 * 11/2006 Martin ..... 422/122
7,171,763 B2 * 2/2007 Kim ..... 34/527
7,173,538 B2 * 2/2007 Pedraza et al. ..... 340/604
7,186,371 B1 * 3/2007 Watling ..... 422/3
7,229,066 B2 * 6/2007 Newman et al. ..... 261/78.2
7,238,330 B2 * 7/2007 Hill et al. ..... 422/292
7,275,400 B2 * 10/2007 Severns et al. ..... 68/18 F
7,308,808 B2 * 12/2007 Hallman et al. ..... 68/18 C
7,310,893 B2 * 12/2007 Woerdehoff et al. ..... 34/527
7,322,126 B2 * 1/2008 Beaulac ..... 34/554
7,448,145 B2 * 11/2008 Kim ..... 34/562
7,478,486 B2 * 1/2009 Wunderlin et al. ..... 34/491
7,491,371 B2 * 2/2009 Moller et al. ..... 422/292
7,503,127 B2 * 3/2009 DuVal et al. ..... 34/381
7,541,002 B2 * 6/2009 Centanni ..... 422/68.1
7,603,878 B2 * 10/2009 Fyvie ..... 68/18 R
7,640,782 B2 * 1/2010 Hill ..... 73/1.02
7,655,004 B2 * 2/2010 Long ..... 606/37
7,674,440 B2 * 3/2010 Martin ..... 422/295
7,681,328 B2 * 3/2010 DuVal et al. ..... 34/597
7,711,308 B2 * 5/2010 Hozumi et al. ..... 399/351
7,761,954 B2 * 7/2010 Ziegler et al. ..... 15/320
2003/0050220 A1 * 3/2003 Trinh et al. ..... 510/521
2004/0129032 A1 * 7/2004 Severns et al. ..... 68/5 C
2004/0200093 A1 * 10/2004 Wunderlin et al. ..... 34/606
2005/0091879 A1 * 5/2005 DuVal et al. ..... 34/597
2005/0183208 A1 * 8/2005 Scheper et al. ..... 8/142
2006/0059632 A1 * 3/2006 Fyvie ..... 8/158
2006/0191161 A1 * 8/2006 Wunderlin et al. ..... 34/562
2007/0271814 A1 * 11/2007 Bae et al. ..... 34/524
2008/0134458 A1 * 6/2008 Ziegler et al. ..... 15/320
2008/0140255 A1 * 6/2008 Ziegler et al. ..... 700/245
2008/0155768 A1 * 7/2008 Ziegler et al. ..... 15/4
2010/0115785 A1 * 5/2010 Ben-Shmuel et al. ..... 34/260

FOREIGN PATENT DOCUMENTS

JP 63292052 A * 11/1988
JP 02019760 A * 1/1990
JP 06288673 A * 10/1994
JP 06296798 A * 10/1994
JP 07103504 A * 4/1995
JP 08193966 A * 7/1996
JP 08193967 A * 7/1996
JP 08261971 A * 10/1996
JP 11332915 A * 12/1999
WO WO 03/071864 A2 * 9/2003

* cited by examiner

APPARATUS FOR AUTOMATICALLY DRYING AND METHOD FOR CONTROLLING THE SAME

TECHNICAL FIELD

The present invention relates to an apparatus and a method for automatic drying, and more particularly, to an apparatus including a humidity sensor at a location having stabilized output characteristic for enabling to determine dryness exactly by using the humidity sensor, and a method for the same.

BACKGROUND ART

In general, in a drum washer, washing is performed by using friction between a drum and laundries, the drum rotated by receiving a driving force of a motor, when detergent, wash water, and laundries are thrown in the drum, such that laundries are less damaged or tangled, and beating and rubbing washing is effected.

A combination dryer and drum washer for performing not only washing and dehydrating but also drying process is on an increasing trend following the trend of improvement and high quality of the drum washer.

The combination dryer and drum washer dries laundry by sucking up outside air into a fan and a heater provided at an outside of a tub, heating the air, and blowing the heated high temperature air into the tub.

A drum type dryer that is not a combination dryer and drum washer is for drying a large amount of laundries at a time in a short period of time by performing just drying.

The dryer is an apparatus for automatically drying a drying object after washing is ended. The dryer dries the drying object to be dried, such as a clothing, thrown in a drying drum by introducing an outside air, heating the external device by using a heater, and blowing the heated high temperature air into the drying drum in a rotating state.

Hereinafter, an automatic drying apparatus applied to a conventional drum washer for automatic drying and to a drum type dryer, is described as follows.

FIG. 1 illustrates a structure showing an example of a location of a temperature sensor used for determining dryness in an automatic dry washer.

Generally, related art performs drying by selecting a drying course a user wants and setting an appropriate drying time according to a load of laundry.

However, the manual drying method does not satisfy dryness the user desires because drying is not performed exactly and the laundry is less dried, or in contrast, over dried.

For solving the problem, as illustrated in FIG. 1, developed is a method for performing drying by detecting temperatures changed in process of drying by means of a tub temperature sensor (Ttub) provided in a tub 11 for detecting temperature in the tub and a duct temperature sensor (TA1) provided in a duct 12 for detecting temperature of the duct, and automatically determining dryness according to difference value ($\Delta T$) of the detected tub temperature and the duct temperature (TA1).

As aforementioned, the method for performing drying includes a step of checking humidity in a washing tub indirectly by using the temperature difference of the temperature in the tub and the temperature in the duct. In other words, expected humidity is calculated by taking a temperature detection value from a temperature sensor of the duct or tub.

FIGS. 2*a* and 2*c* illustrate a structure of an electrode sensor including a drying drum, and a circuit structure thereof.

The automatic drying apparatus determining dryness by using the electrode sensor, as illustrated in FIGS. 2*a* and 2*b*, includes two electrode separated provided at a particular location in the drum a drying object to be dried is thrown therein, and a resistance value changes according to an amount of moisture contained when the electrodes and the drying object to be dried comes in contact.

Therefore, a voltage value is changed according to the changing resistance value, and micom reads the voltage value for determining dryness.

In other words, the resistance value is increased when the amount of moisture contained in the drying object to be dried is decreased. The voltage value is increased in proportion to the resistance value, and the micom determines a point of ending the drying process when the value is reached to a predetermined value.

However, in the method of indirectly determining dryness by using the temperature sensor or the electrode sensor, it is difficult to determine exact dryness because the amount of moisture contained is not directly detected, but the resistance value changed according to temperature of air for drying, or the amount of moisture contained in the drying object to be dried is detected, and the humidity is indirectly calculated.

When the dryness is determined by using the temperature sensor, a passage structure is changed and it is difficult to perform drying exactly due to a location of the temperature sensor in the tub, deviation in the temperature sensor itself, deviation of the duct structure, and deviation of the heater performance.

Particularly, there is a problem for performing drying exactly because the dryness is not determined consistently for all weights.

When the dryness is determined by using the electrode sensor, because of a characteristic of detection by contact with the drying object to be dried, it is difficult to detect dryness for a small amount of laundry, over drying or less drying may be generated, thereby generating waste of power consumption.

DISCLOSURE OF INVENTION

An object of the present invention, for solving the foregoing problem of an automatic drying apparatus and an automatic drying algorithm of a related art, is to provide an apparatus and a method for automatic drying so as to determine dryness exactly by using a humidity sensor provided at a location having a stabilized output characteristic.

To achieve these objects and other advantages and in accordance with the purpose of the invention, as embodied and broadly described herein, the automatic drying apparatus includes a heating apparatus for heating air supplied into a drum into which a drying object is introduced; a fan for forcibly drawing air into the drum; and a humidity sensor provided between the fan and the heating apparatus such that a sensing surface is positioned to be parallel to a flowing direction of air passed through the fan, for outputting a sensing voltage value for determining dryness of the drying object.

The humidity sensor is provided at a duct cover coupled with a back cover and providing a passage for circulating air, the back cover protecting the inside of the drying apparatus including the drum.

The humidity sensor is provided at a supporting plate being parallel to the back cover protecting the inside of the drying apparatus from the air guide guiding the air passed thorough the fan toward the heating apparatus, and elongated toward the inside of the duct.

An automatic drying apparatus provided at an outside of a back cover protecting and shielding the inside thereof and including a heating apparatus for heating air supplied to a drum for introducing drying object to be dried and a fan for blowing the air to the heating apparatus, including a duct cover provided with a duct coupled with the fan and the heating apparatus, and through which air flows; and a humidity sensor for detecting humidity of air passed through the fan and having a sensing surface located in the duct cover and coupled with the duct cover so as to be parallel to a proceeding direction of the air passed through the fan.

An automatic drying apparatus provided at an outside of a back cover protecting and shielding the inside thereof and including a heating apparatus for heating air supplied to a drum for introducing drying object to be dried and a fan for blowing the air to the heating apparatus, including an air guide provided at one side of the fan and extended from the fan toward the heating apparatus for a predetermined length and having an air guiding surface provided to be parallel to a surface of a back cover, for guiding the air blown by the fan toward the heating apparatus; a duct cover provided with a duct through which air flows and being coupled with the back cover so as to tightly close the fan, the heating apparatus and the air guide; and a humidity sensor coupled with one side of the air guide for detecting humidity of the air passed through the fan.

An automatic drying apparatus provided at an outside of a back cover protecting and shielding the inside thereof and including a heating apparatus for heating air supplied to a drum for introducing drying object to be dried and a fan for blowing the air to the heating apparatus, including a duct cover provided with a duct through which air flows and being coupled with the back cover so as to tightly close the fan, the heating apparatus and the air guide; a supporting plate having a first end coupled with an inner structure of the duct, and both sides being separated from corresponding inner surfaces of the duct; and a humidity sensor coupled with the supporting plate, and having a sensing surface provide to be parallel to a side of the supporting plate and detecting humidity of the air passed through the fan.

A controlling method of an automatic drying apparatus for controlling dryness by detecting humidity of a drying object, comprising the steps of: detecting humidity of the drying object after drying process is started; dividing the drying object on the basis of an output voltage value of the humidity sensor detecting humidity; and determining dryness by applying a different dryness determination value according to a division of the drying object even though a drying mode is the same.

At the step of dividing the drying object, the drying object is divided on the basis of a time elapsed from a starting point of drying to a point that an output voltage value of the humidity sensor becomes a minimum value.

At the step of dividing the drying object, the drying object is divided on the basis of a level of the minimum voltage value outputted from the humidity sensor after drying is started.

At the step of dividing the drying object, the step of dividing the drying object on the basis of the time elapsed from a starting point of drying to a point that an output voltage value of the humidity sensor becomes a minimum value and the step of dividing the drying object on the basis of a level of the minimum voltage value outputted from the humidity sensor after drying is started are both applied.

A controlling method of an automatic drying apparatus for controlling dryness by detecting humidity of a drying object, comprising the steps of: detecting a minimum voltage value (Vmin) of a humidity sensor detecting humidity of the drying object when drying is started; dividing the drying object by comparing a time elapsed before a point of outputting the minimum voltage value and a standard time; and determining dryness by comparing a voltage change amount (ΔV) from the minimum voltage value with one of preset standard dryness determination value according to a result of the division.

It is judged that a weight in case of detecting the minimum voltage value (Vmin) before the standard time is smaller than that in a case of detecting the minimum voltage value (Vmin) after the standard time.

In a higher drying mode, a larger voltage change amount (ΔV) is required for satisfying a dryness determination value.

In a same drying mode, the voltage change amount (ΔV) that is required when the minimum voltage value (Vmin) is detected before the standard time is larger than the voltage change amount (ΔV) that is required when the minimum voltage value (Vmin) is detected after the standard time.

A controlling method of an automatic drying apparatus for controlling dryness by detecting humidity of a drying object, comprising the steps of: detecting a minimum voltage value (Vmin) of a humidity sensor detecting humidity of the drying object when drying is started; dividing the drying object by comparing the detected minimum voltage value (Vmin) with a preset standard voltage value; and determining dryness by comparing a voltage change amount (ΔV) from the minimum voltage value with one of preset standard dryness determination value according to a result of the division.

In a same drying mode, the voltage change amount (ΔV) that is required when the detected minimum voltage value (Vmin) is larger than the standard voltage value is larger than the voltage change amount (ΔV) that is required when the detected minimum voltage value (Vmin) is smaller than the standard voltage value.

A controlling method of an automatic drying apparatus for controlling dryness by detecting humidity of a drying object, comprising the steps of detecting a minimum voltage value (Vmin) of a humidity sensor detecting humidity of the drying object when drying is started; dividing the drying object by comparing a time elapsed before a point of outputting the minimum voltage value with a standard time; dividing the drying object by comparing the detected minimum voltage value (Vmin) with a preset standard voltage value when the time elapsed is larger; and determining dryness by comparing a voltage change amount (ΔV) from the minimum voltage value with one of preset standard dryness determination value according to a result of the division.

It is judged that a weight in case of detecting the minimum voltage value (Vmin) before the standard time is smaller than that in a case of detecting the minimum voltage value (Vmin) after the standard time, and that a weight in case that the detected minimum voltage value (Vmin) is larger than the standard voltage value is larger than a weight in case that the detected minimum voltage value (Vmin) is smaller than the standard voltage value.

Even in case that the weigh of the minimum voltage value detected after the standard time is larger, the weight is judged to be small when the minimum voltage value is judged to be larger at the step of comparing the detected minimum voltage value (Vmin) with the preset standard voltage value.

A point of detecting the minimum voltage value (Vmin) is divided into a time before the standard time and a time after the standard time, and a first standard dryness determination value (Δ V1) is applied when the minimum voltage value (Vmin) is detected before the standard time, and a second standard dryness determination value (Δ V2) is applied when the minimum voltage value (Vmin) is detected after the standard time and when the minimum voltage value (Vmin) is smaller than the standard voltage value, or the first standard dryness determination value (Δ V1) is applied.

BRIEF DESCRIPTION OF DRAWINGS

The accompanying drawings, which are included to provide a further understanding of the invention, illustrate embodiment(s) of the invention and together with the description serve to explain the principle of the invention. In the drawings.

BEST MODE FOR CARRYING OUT THE INVENTION

Reference will now be made in detail to the preferred embodiments of the present invention, examples of which are illustrated in the accompanying drawings. In describing the embodiments, parts the same with the related art fuel cell will be given the same names and reference symbols, and detailed description of which will be omitted.

Figure 1:
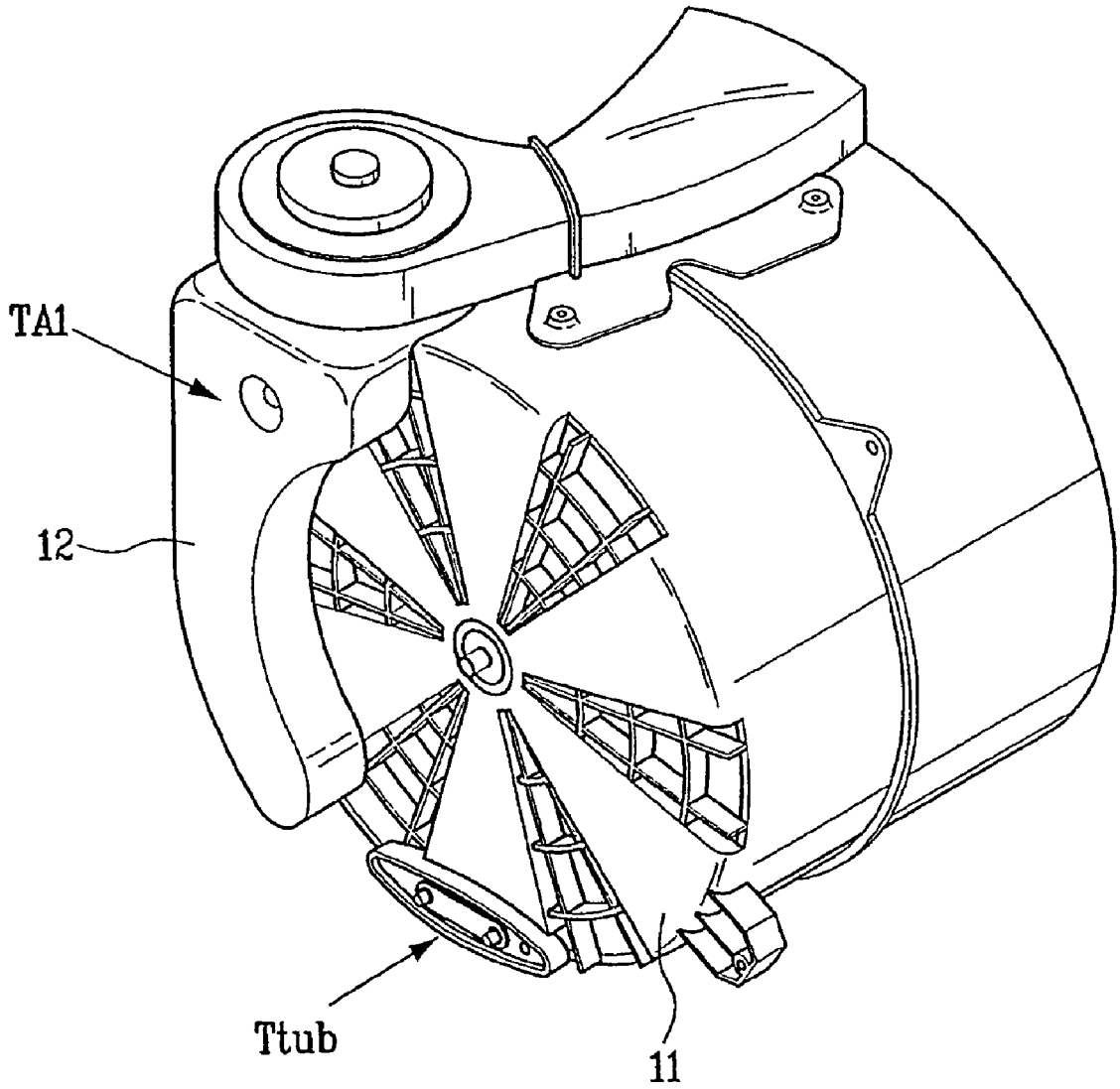
FIG. 1 illustrates a structural view showing an example of a temperature sensor location used for determining dryness in an automatic dry washer.
Figure 2A:
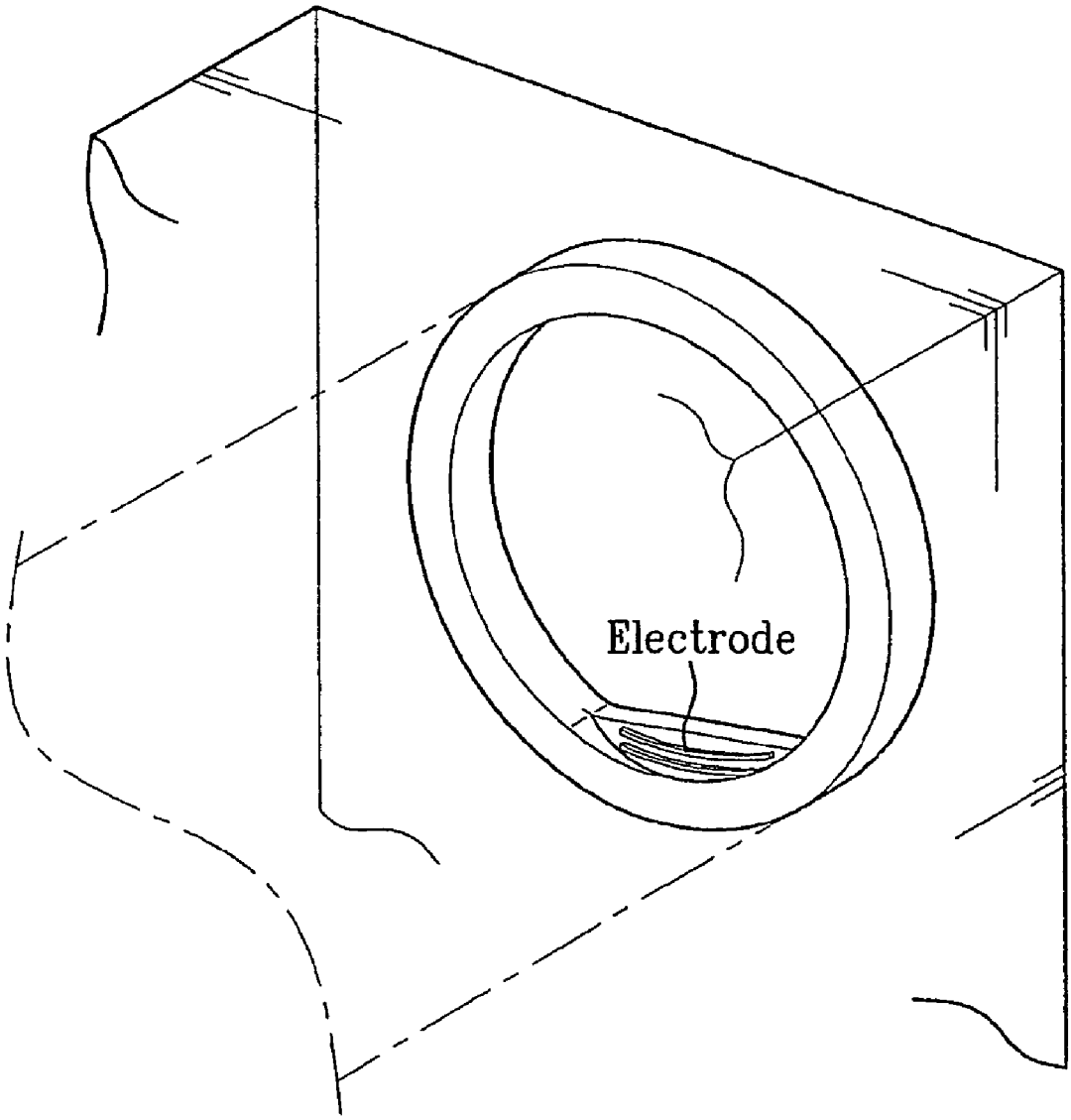
FIG. 2 illustrates a structural view showing structure of an electrode in a drying drum and a circuit structure thereof.
Figure 2B:
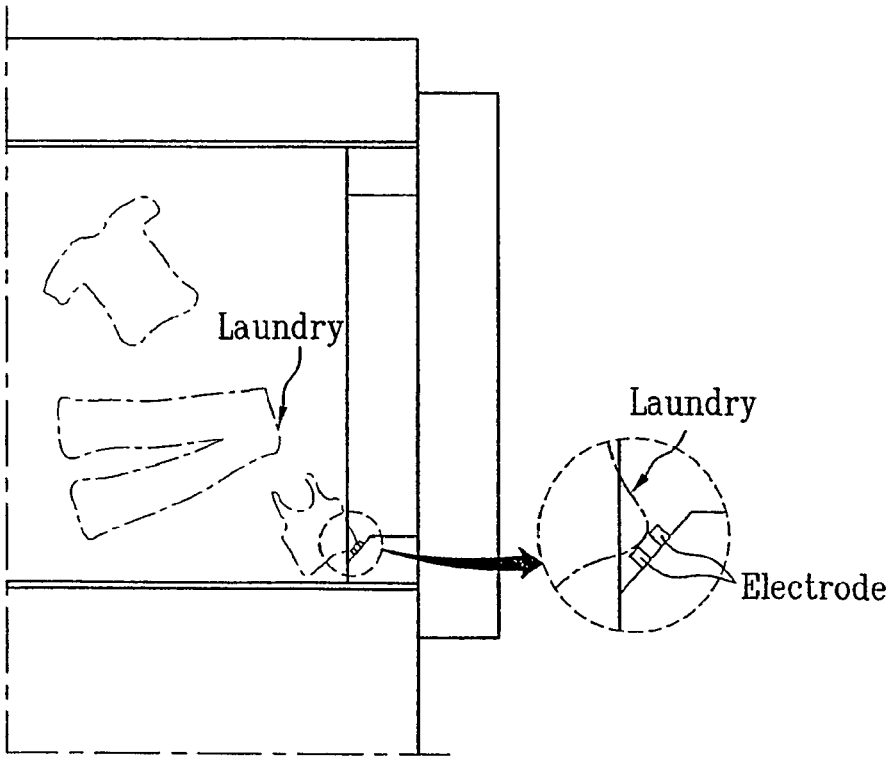
Figure 2C:
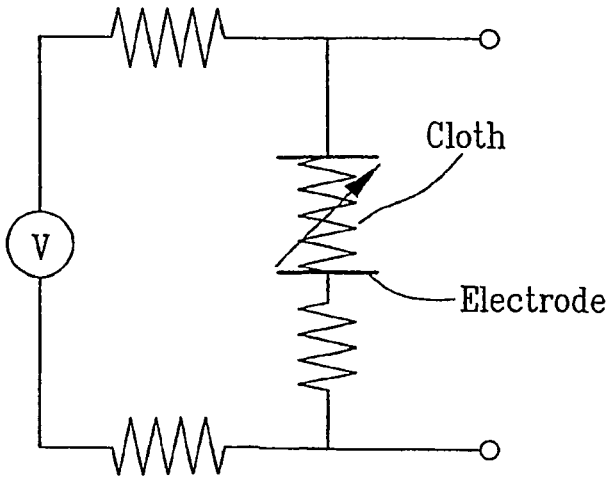
Figure 3:
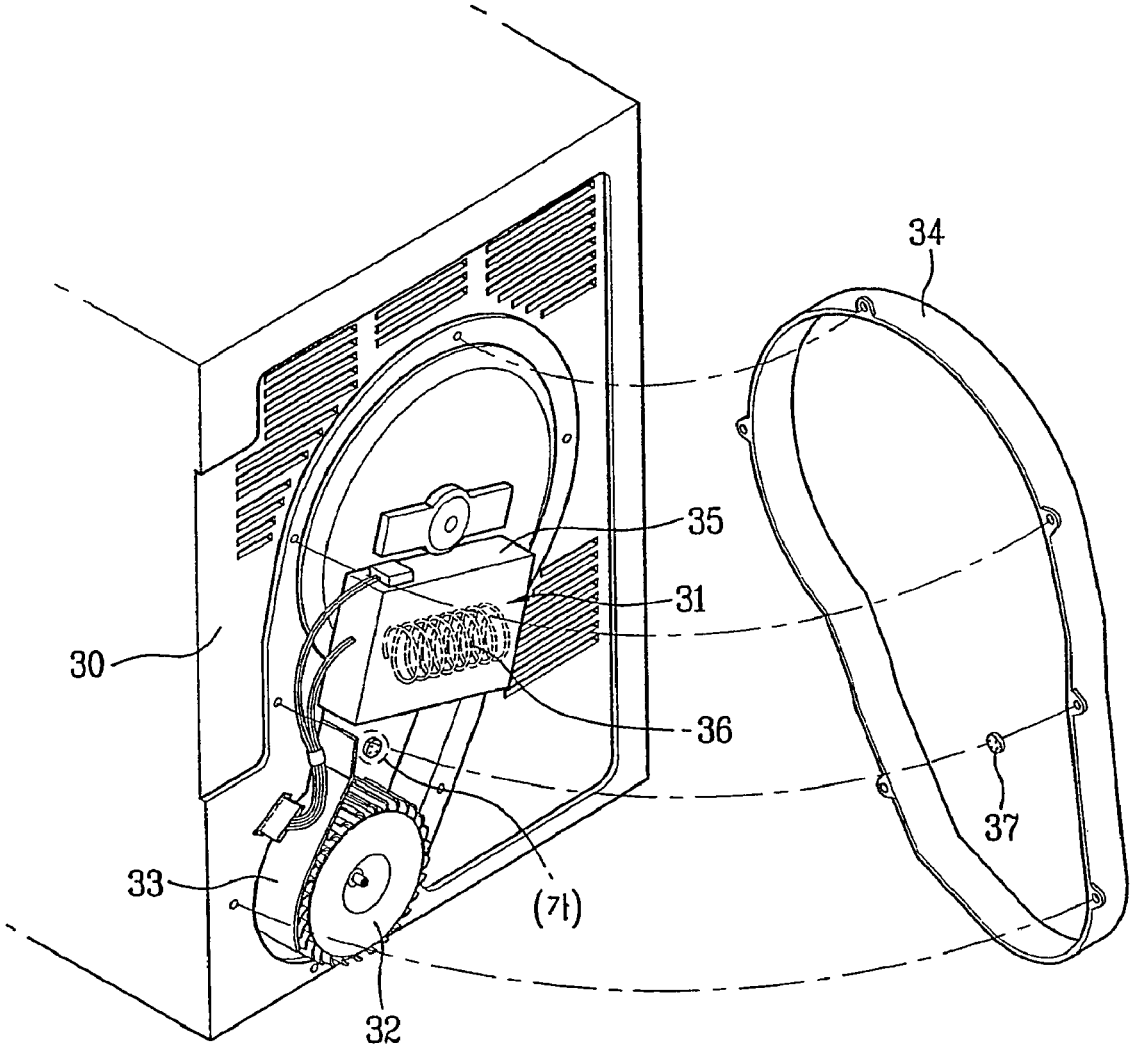
FIG. 3 illustrates a structural view showing a humidity sensor of an automatic drying apparatus in accordance with a first embodiment of the present invention.
Figure 4A:
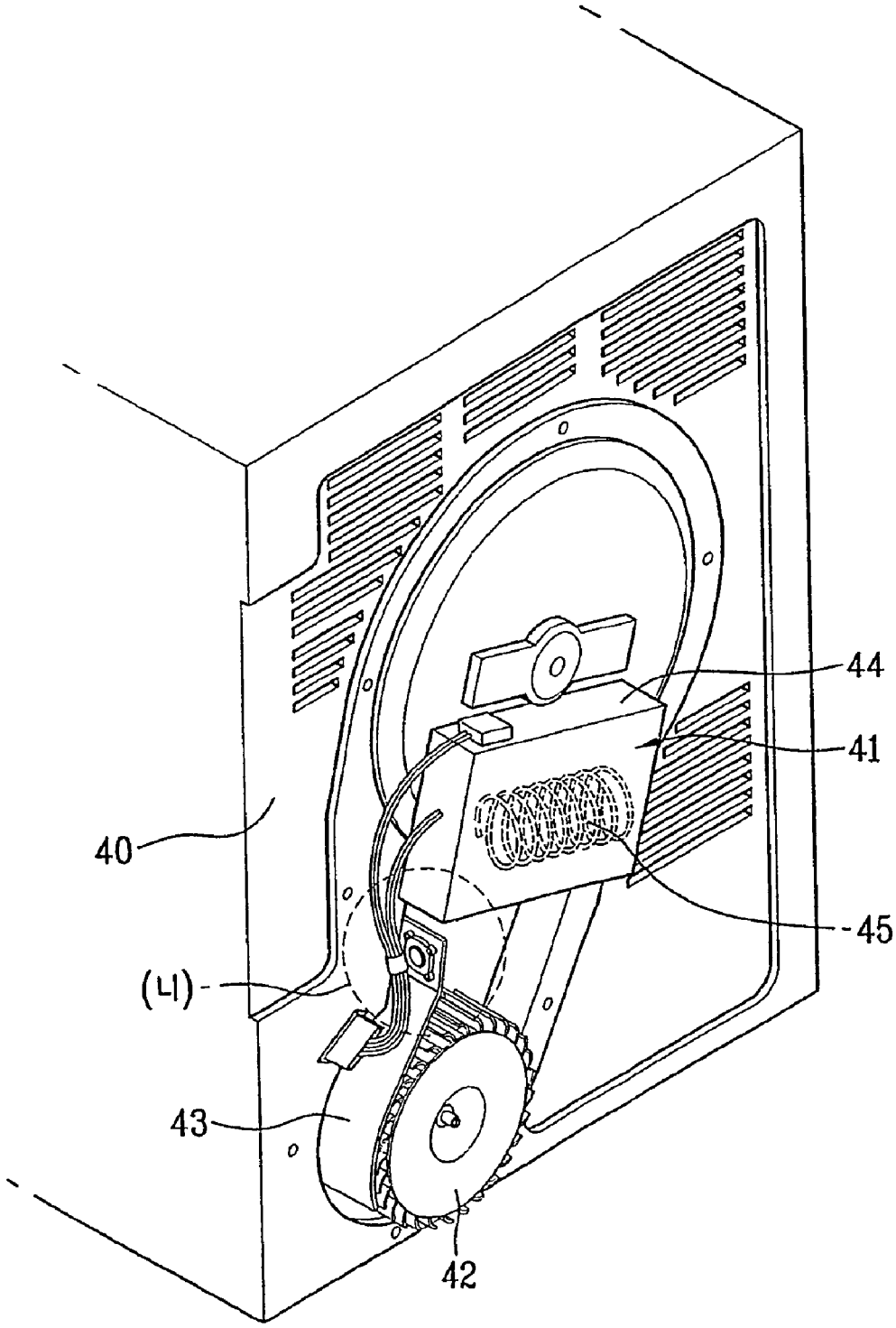
FIGS. 4*a* and 4*b* illustrate a structural view showing a humidity sensor of an automatic drying apparatus in accordance with a second embodiment of the present invention.
Figure 4B:
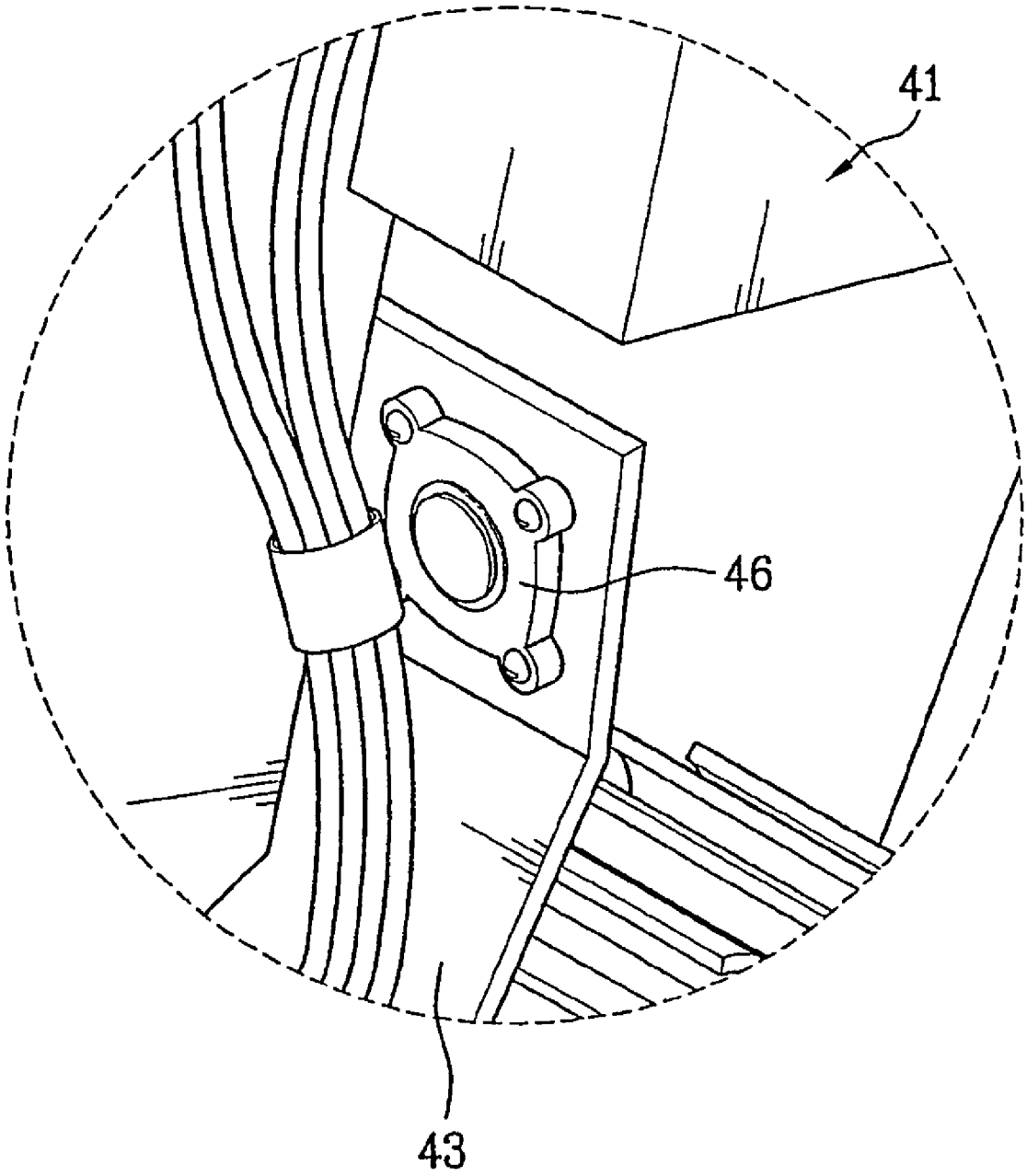
Figure 5A:
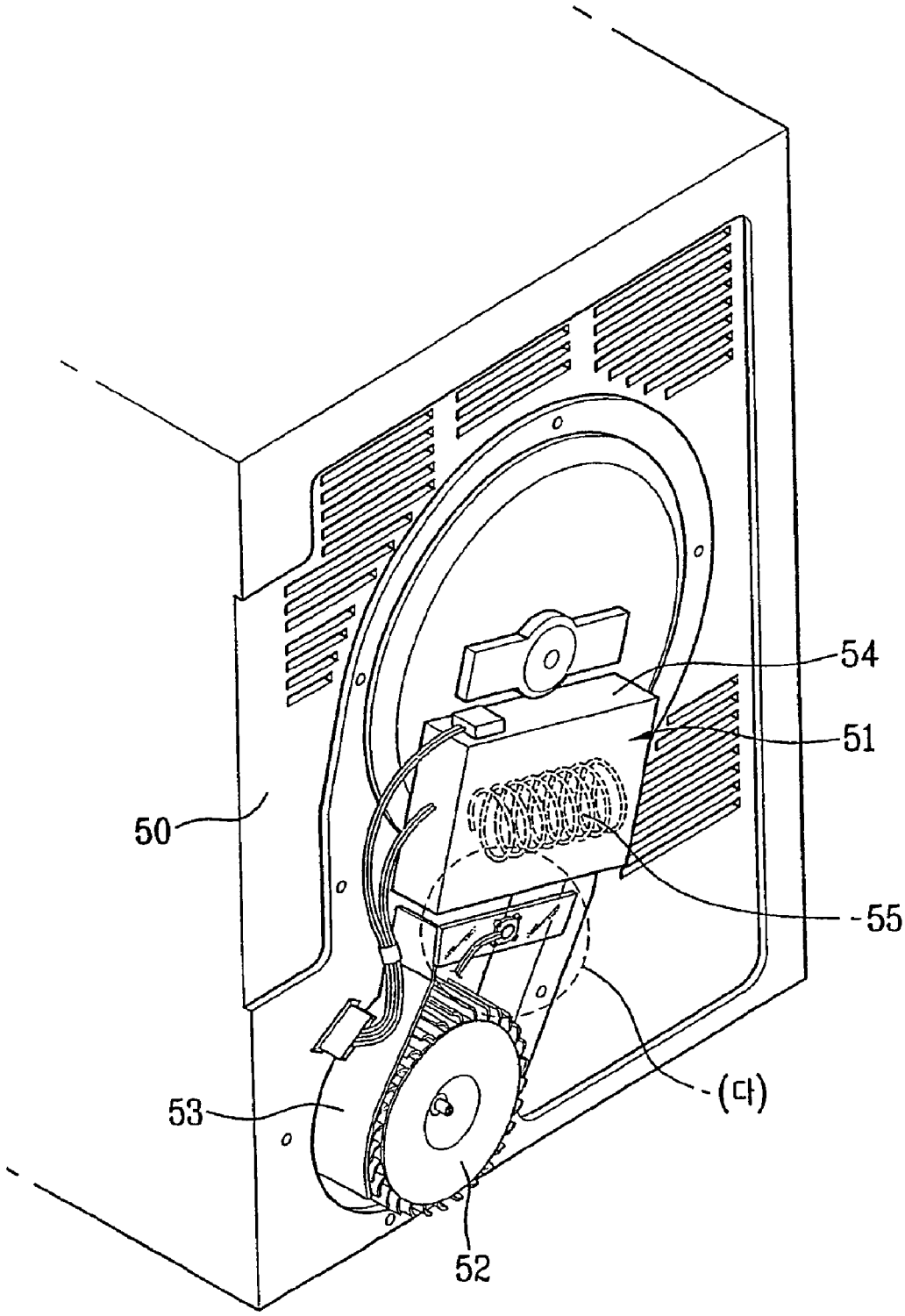
FIGS. 5*a* and 5*b* illustrate a structural view showing a humidity sensor of an automatic drying apparatus in accordance with a third embodiment of the present invention.
Figure 5B:
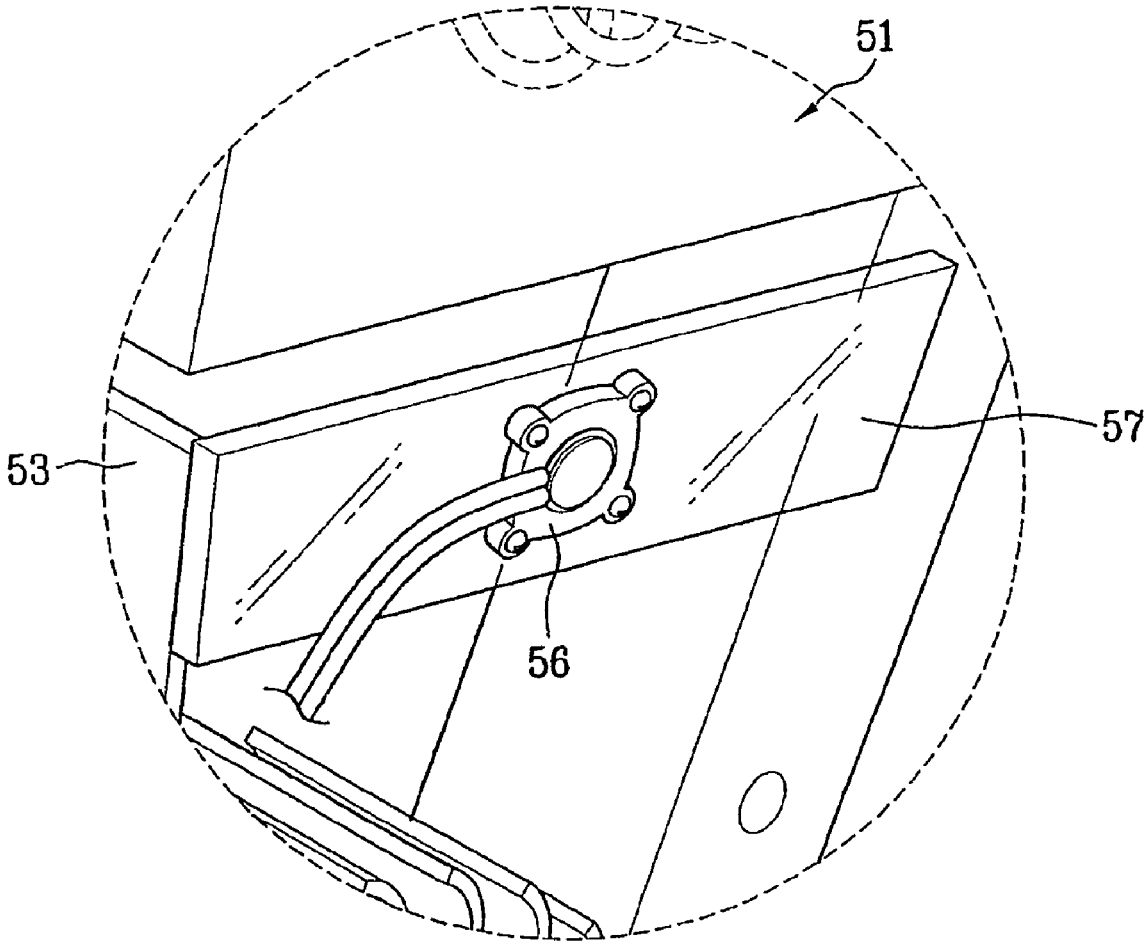

FIG. 3 illustrates a structural view showing a humidity sensor of an automatic drying apparatus in accordance with a first embodiment of the present invention. FIGS. 4*a* and 4*b* illustrate a structural view showing a humidity sensor of an automatic drying apparatus in accordance with a second embodiment of the present invention, and FIGS. 5*a* and 5*b* illustrate a structural view showing a humidity sensor of an automatic drying apparatus in accordance with a third embodiment of the present invention.

The present invention is to provide an automatic drying apparatus including a humidity sensor directly detecting dryness of laundries at an optimum location having a stabilized output characteristic for enabling to estimate dryness exactly.

The present invention is also to provide a drying algorithm for stably estimating dryness by removing an influence according to an outside or inside influence and weight, and an influence according to a status change of laundries by using the detection result of the humidity sensor.

Since humidity environment of the automatic drying apparatus is very fluid, it is necessary to minimize an error from generating by abnormal data so as to determine dryness exactly by using the humidity sensor.

Accordingly, the present invention has a new structure for configuring the sensor at a location for preventing an error in determination of dryness from generating by a noise and an abnormal phenomenon, the noise caused from condensed water and cooling water, and introduces a method for controlling dryness determination so as to determine dryness exactly by using stabilized output characteristic.

In structure, a humidity sensor is provided between a heater for heating air supplied into the drum and a fan for forcibly drawing air, and a sensing surface of the humidity sensor is positioned to be parallel with the flow of air passing through the fan for preventing the air containing a large amount of moisture from hitting to the humidity sensor directly.

Hereinafter, 'the sensing surface of the humidity sensor' means a sensing part for detecting humidity. The sensing surface in a front surface and a heater part except the sensing part and a part including power supply member in a rear surface will be described.

First of all, the structure of the humidity sensor at the automatic drying apparatus in accordance with the present invention is described as follows. The rear surface of the automatic drying apparatus in accordance with the present invention is described with reference to FIG. 3, the automatic drying apparatus including a heating apparatus 31 for heating air on a rear surface of a ventilator (not shown) communicated with the drum the drying object to be dried is thrown therein, a centrifugal fan 32 for blowing air to the heating apparatus 31, and an air guide 33 extended from a side of the centrifugal fan 32 toward the heating apparatus 31 for guiding the air blown by the fan 32 toward the heating apparatus 31.

The heating apparatus 31, the centrifugal fan 32, and the air guide 33 are provided at an outside of a back cover 30 protecting and shielding the inside of the drying apparatus.

The air guide 33 has a first end formed nearby an inlet of the heating apparatus 31, and a second end extended along the shape of the duct to a parallel line on the basis of a central axis of the centrifugal fan 32.

A duct is formed by the duct cover 34 being coupled with the central fan 32, the heating apparatus 31 and the air guide 33 so as to be tightly closed, and the central fan 32, the heating apparatus 31 and the air guide 33 are positioned in the duct.

The heating apparatus 31 includes a heater housing 35 having both sides opened, and a heater 36 provided in the heater housing 35.

The duct cover 34 includes a humidity sensor 37 having a humidity sensing surface positioned to face a direction parallel to an inner surface of the duct cover 34. When the duct cover 34 is coupled with the back cover 30, the humidity sensor 37 is positioned at (A) between the centrifugal fan 31 and the heating apparatus 32 so as to determine humidity of air blown by the centrifugal fan 32.

In this instance, the humidity sensing surface maintains to be parallel to the flow of air blown to prevent heating the air directly.

In the automatic drying apparatus in accordance with the present invention, output characteristic is stabilized and a structural margin in the duct is secured enough because an influence changing the sensing characteristic of the humidity sensor is minimized.

The structure of the automatic drying apparatus in accordance with the second embodiment of the present invention is described as follows.

In the structure of the humidity sensor in accordance with the second embodiment of the present invention, the air guide is provided such that manufacture is easy and noise in sensing operation of the humidity sensor is decreased.

If described on the basis of the rear surface of the automatic drying apparatus in accordance with the second embodiment of the present invention with reference to FIGS. 4*a* and 4*b*, the automatic drying apparatus includes a heating apparatus 41 for heating air on the rear surface of the ventilator (not shown) communicated with the drum the drying object to be dried is thrown therein, a centrifugal fan 42 for blowing the heating apparatus 41, and an air guide 43 extended from a side of the centrifugal fan 42 toward the heating apparatus 41 for guiding the air, blown by the fan 32, toward the heating apparatus 31.

The heating apparatus 41, the centrifugal fan 42, and the air guide 43 are provided at an outside of a back cover 40 protecting and shielding the inside of the drying apparatus.

A duct is formed by the duct cover (not shown) being coupled with the central fan 42, the heating apparatus 41 and the air guide 43 so as to be tightly closed, and the central fan 42, the heating apparatus 41 and the air guide 43 are positioned in the duct.

The heating apparatus 41 includes a heater housing 44 having both sides opened, and a heater 45 provided in the heater housing 44.

A humidity sensor 46 is provided at an end of the air guide 43, and a sensing surface of the humidity sensor 46 is positioned to be parallel with the flow of air passing through the fan for preventing the air containing a large amount of moisture from hitting to the humidity sensor directly.

The air guide 43 has a first end formed nearby an inlet of the heating apparatus 41, and a second end extended along shape the duct to a parallel line on the basis of a central axis of the centrifugal fan 42.

The humidity sensor 46 is provided at a first end of the air guide 43, that is, a part close to the heating apparatus 41. During the drying process, the humidity sensor 46 is positioned at (B) section between the centrifugal fan 42 and the heating apparatus 41 so as to determine the humidity of air blown by the fan 42.

The structure of the humidity sensor of the automatic drying apparatus in accordance with the third embodiment of the present invention is to provide a structure of the humidity sensor having the stabilized output characteristic without changing the duct cover and without influencing the structural margin of the duct, and the humidity sensor is provided at a humidity sensor supporting plate coupled with the structure in the duct including the air guide.

If described on the basis of the rear surface of the automatic drying apparatus in accordance with the third embodiment of the present invention with reference to FIGS. 5*a* and 5*b*, the automatic drying apparatus includes a heating apparatus 51 for heating air on the rear surface of the ventilator (not shown) communicated with the drum the drying object to be dried is thrown therein, a centrifugal fan 52 for blowing the heating apparatus 51, and an air guide 53 extended from a side of the centrifugal fan 52 toward the heating apparatus 51 for guiding the air, blown by the fan 52, toward the heating apparatus 51.

The heating apparatus 51, the centrifugal fan 52, and the air guide 53 are provided at an outside of a back cover 50 protecting and shielding the inside of the drying apparatus.

A duct is formed by the duct cover (not shown) being coupled with the central fan 52, the heating apparatus 51 and the air guide 53 so as to be tightly closed, and the central fan 52, the heating apparatus 51 and the air guide 53 are positioned in the duct.

The heating apparatus 51 includes a heater housing 54 having both sides opened, and a heater 55 provided in the heater housing 54.

In this case, a part of the humidity sensor supporting plate 57 is coupled with one end of the air guide 53, and the sensing surface of the humidity sensor 56 is exposed to the supporting plate 57.

In other words, the humidity sensor 56 is parallel with the back cover 50 protecting the inside of the drying apparatus from the air guide 53 guiding the air passes through the centrifugal fan 52 toward the heating apparatus 51, and is composed at the supporting plate 57 extended toward the inside of the duct.

The sensing surface of the humidity sensor 56 is configured to be parallel with the flow of air for preventing from directly hitting the flow of air flown by the rotation of the centrifugal fan 52.

The air guide 53 has a first end formed nearby an inlet of the heating apparatus 51, and a second end extended along shape the duct to a parallel line on the basis of a central axis of the centrifugal fan 32. The supporting plate 57 is coupled with one end of the air guide 53, that is a portion close to the heating apparatus 51.

During drying process, the humidity sensor 56 is positioned at (C) section between the centrifugal fan 52 and the heating apparatus 51 so as to determine the humidity of air blown by the fan 52.

The method for automatic drying of the drying apparatus in accordance with the present invention having a structure including the humidity sensor attached is described as follows.

Figure 6:
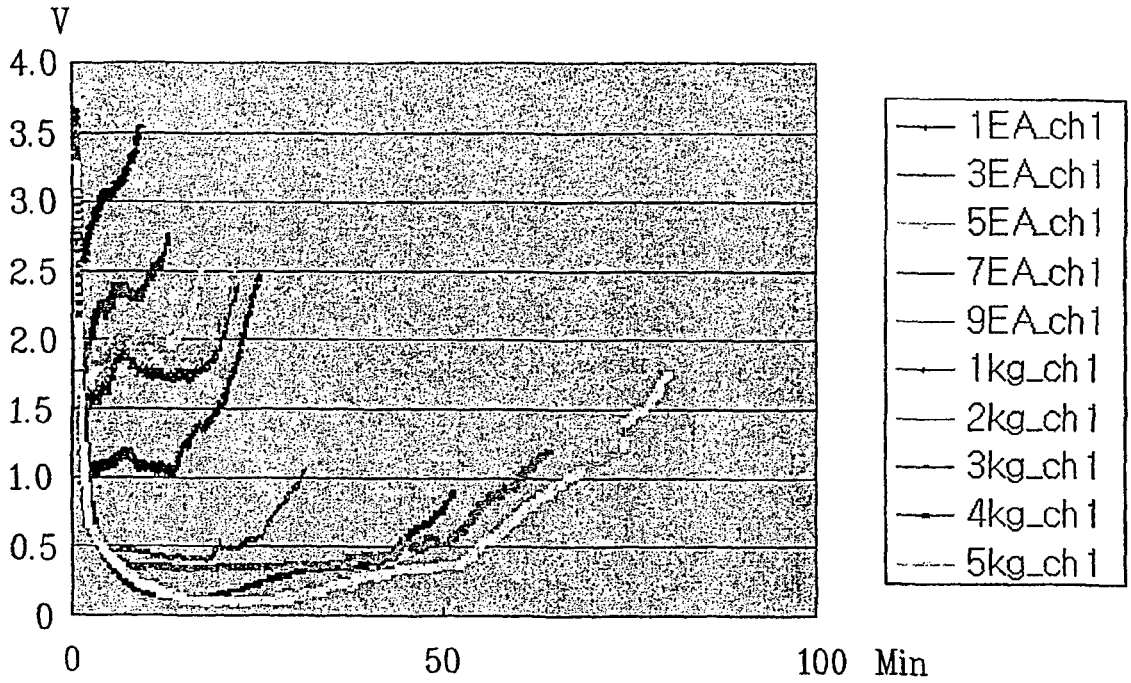
FIG. 6 illustrates a graph showing a range of dryness according to weights in each drying mode when a fixed dryness determination value (A) is used.
Figure 7A:
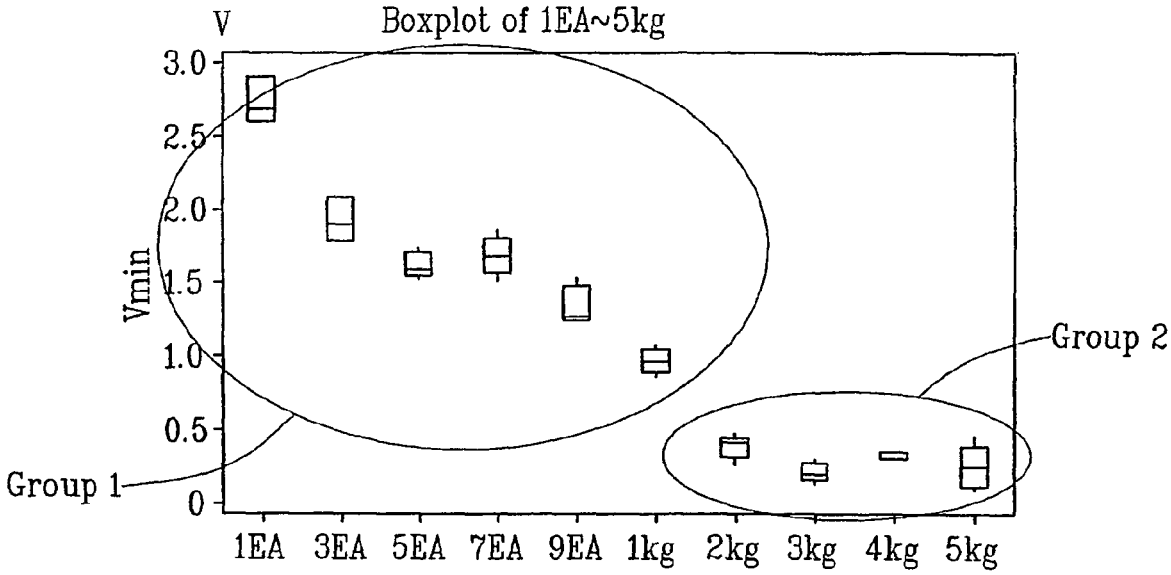
FIGS. 7*a* and 7*b* illustrate a distribution chart showing a minimum voltage value by weights, and detection points of an automatic drying apparatus in accordance with the present invention.
Figure 7B:
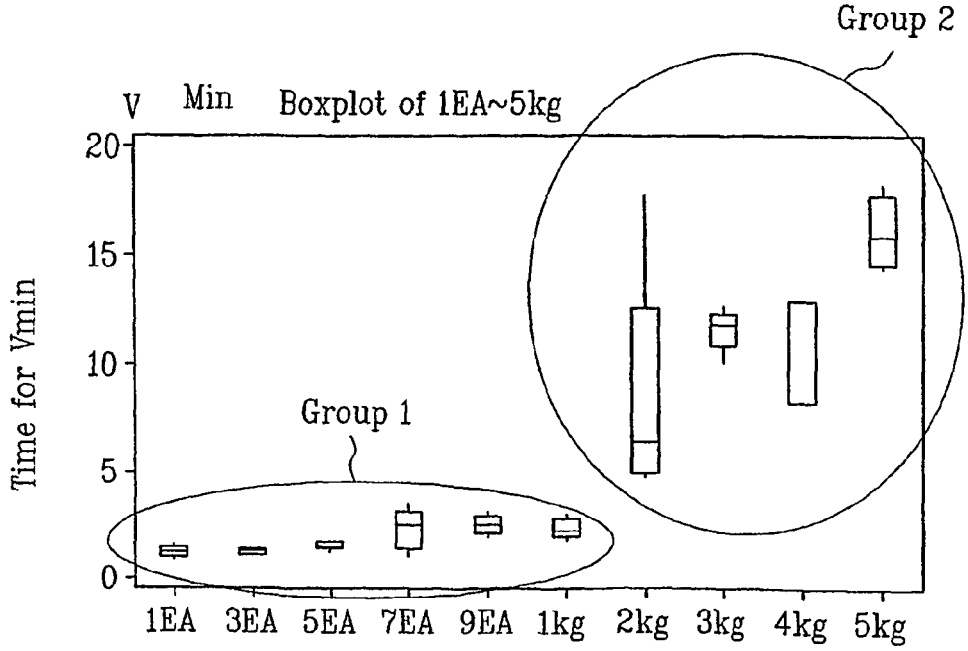

FIG. 6 is a graph showing output characteristics of the humidity sensor of the automatic drying apparatus according to weights in accordance with the present invention, and FIGS. 7*a* and 7*b* illustrate a distribution chart showing a minimum voltage value and a detection point of an automatic drying apparatus according to weights in accordance with the present invention.

Hereinafter, the minimum voltage value (Vmin) means an output voltage value of the humidity sensor at a point of maximum moisture absorbed by air along the drying process, and both a voltage change amount indicating difference between the present voltage value and the minimum voltage value (Vmin) and a dryness determination value for determining the dryness are indicated as ($\Delta V$).

For enabling the dryness determination, the present invention divides the drying object on the basis of the time for reaching the minimum voltage and a level of the detected minimum voltage and applies a different dryness determination value according to the divided groups.

As shown in FIG. 6, it is noticed that the output characteristic of the humidity sensor is different by weights during the drying process.

In the humidity sensor, the sensor output is closer to the minimum value (OV) with more humidity contained in the drying object to be dried, and the sensor output becomes a maximum value (5V) when the drying process is process and the humidity is removed.

Since humidity contained in circulating air is low at a starting point of the drying process, the output value of the humidity sensor is close to the maximum value.

When the drying process is started in earnest, humidity of the drying object is decreased because air drawn into the drying drum absorbs humidity of the drying object to be dried. In this instance, the circulating air contains a large amount of humidity, and the output value of the sensor becomes the minimum value at a point when the circulating air contains the maximum humidity.

At the close of drying process, the output value of the humidity sensor is increased because the humidity of the drying object to be dried is decreased and the humidity absorbed by the circulating air is decreased.

As shown in the output characteristic during the drying process, the time till reaching the minimum output value of the sensor and the level of the minimum value are changed according to the weight.

There are different output characteristics according to weights, and it is difficult to determine the exact dryness when the dryness is determined by using the same dryness determination value for all weights.

In the present invention, the drying object to be dried is divided by the following method for applying the dryness determination value on a different basis.

As illustrated in FIG. 7, the minimum voltage value (Vmin) is outputted with a different level according to the weight, and the minimum voltage value has a high level for a small amount (1 EA-1 Kg) and a low level at a middle and large amount (2 Kg-5 Kg).

In other words, it is shown that the level distribution of the minimum voltage value (Vmin) may be divided according to weight. The small amount and the middle and large amount are divided again into a first group and a second group.

For example, when the level of the detected minimum voltage value (Vmin) after the drying process is started, the weight is determined as the small amount and divided into the first group, and when the level of the detected minimum voltage value (Vmin) is lower than the standard voltage, the amount is determined as the middle and large amount and divided into the second group.

In this case, if the standard voltage is set at 0.5V, the weight is determined as the small amount and divided into the first group when the voltage level is more than 0.5V, and the weight is determined as the middle and large amount and divided into the second group when the voltage level is less than 0.5V.

The following is the reason why the minimum voltage value is higher when the weight is small than when the weight is middle and large.

The humidity sensor has a characteristic of outputting a value close to the minimum output value (OV) when the amount of humidity, absorbed by the air for drying is larger. When the drying object to be dried is small amount, the level of the minimum voltage value (Vmin) outputted by the humidity sensor is increased because the amount of humidity absorbed by the air is small.

There is another method of using the different time till reaching the minimum voltage value (Vmin) according to the weight for dividing the drying object to be dried so as to apply different dryness determination value (ΔV) as illustrated in FIG. 7.

The distribution tendency is that the time till reaching to the minimum voltage value (Vmin) is short at the small amount (1 EA-1 Kg) and long at the middle and large amount (2 Kg-5 Kg).

In other words, the distribution range for reaching the minimum voltage value (Vmin) is divided according to the weight, and the small amount is divided into the first group and the middle and large amount is divided into the second group.

For example, when the time from starting the drying to point of detecting the minimum voltage value (Vmin) is within the standard time, the weight is determined as the small amount and divided into the first group, and when the time is out of the standard time, the weight is determined as the middle and large amount and divided into the second group.

In this case, if the standard time is set at 4 min, the weight is determined as the small amount when the minimum voltage value (Vmin) is detected within 4 min from the starting point of drying, and the weight is determined as the middle and large amount when the minimum voltage value (Vmin) is detected after 4 min from the starting point of drying.

It is obvious that the standard time or the standard voltage are not applied as one step, but divided into many steps and applied, then different dryness determination value (ΔV) is applied according to the divided many groups.

A group is divided for applying different dryness determination value on the basis of the weight, and the dryness is determined in the following method.

Figure 8:
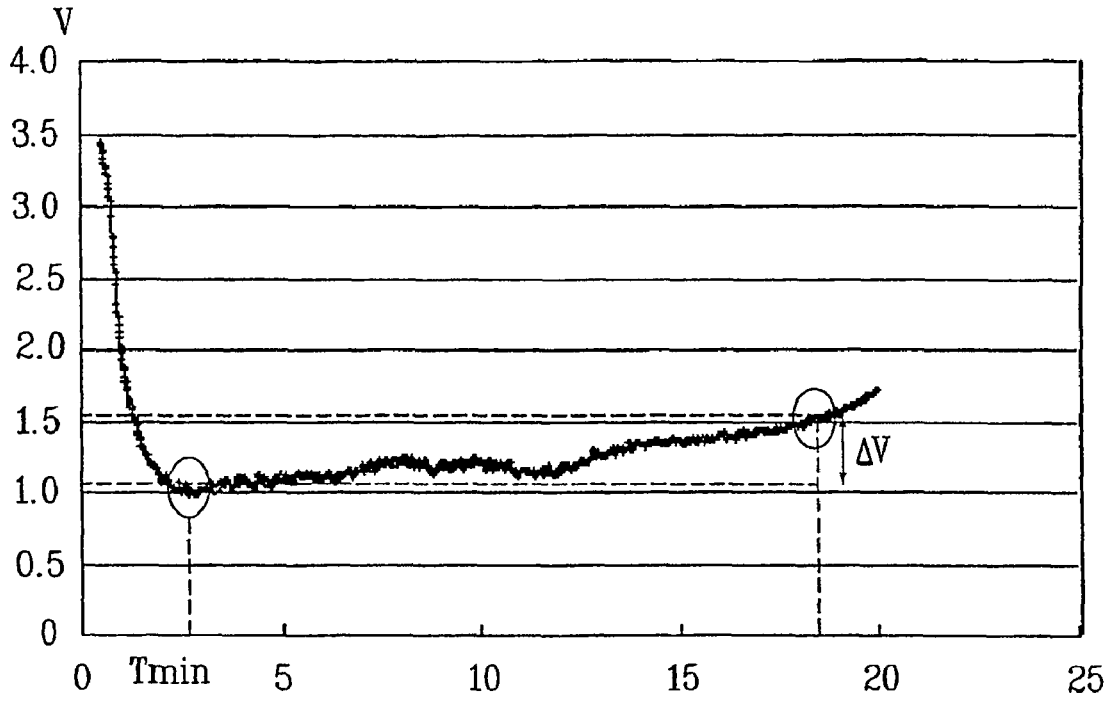
FIG. 8 illustrates a graph showing a detection characteristic of a voltage change value (ΔV) for determining dryness in accordance with the present invention.

FIG. 8 illustrates a graph showing a detection characteristic of voltage change value (ΔV) for determining dryness in accordance with the present invention.

After the drying process is started, when the minimum voltage value (Vmin) is detected, the voltage change amount is detected from the minimum voltage value (Vmin). When the size of the voltage change amount becomes the standard dryness determination value (ΔV), it is judged that the dryness is achieved in the corresponding drying mode.

The graph in FIG. 8, of course, shows an example for a particular weight, and thus a graph showing a characteristic for another weight will be differently illustrated.

However, it is the same that it is judged as that the dryness is achieved when the voltage change amount from the minimum voltage value (Vmin) becomes the standard dryness determination value (ΔV).

The dryness determination values (ΔV) of the first group and the second group divided by using the characteristics of FIG. 7*a* and FIG. 7*b* are differently applied at the step of determining the dryness.

For example, for exact dryness determination, the different dryness determination value (ΔV) is applied according to the first group and the second group and the drying mode are applied as illustrated in Table 1.

It is obvious that the dryness determination value (ΔV) in Table 1 shows an example and another value can be used.

TABLE 1

| Division according to weight | Drying mode | Drying determination value (ΔV) |
|---|---|---|
| First group (1EA-1 Kg) | Ironing | ΔV = 0.2-0.3 |
| | Dry | ΔV = 0.4-0.8 |
| | Strong | ΔV = 0.9-1.2 |
| Second group (2 Kg-5 Kg) | Ironing | ΔV = 1.0-1.2 |
| | Dry | ΔV = 0.3-0.7 |
| | Strong | ΔV = 0.7-1.0 |

As aforementioned, in the present invention, after the drying process is started, the drying object is divided for applying different dryness determination values (ΔV) on the basis of the time elapsed till the output of the humidity sensor becomes the minimum voltage value (Vmin), or divided for applying different dryness determination value (ΔV) according to the level of the detected minimum voltage value (Vmin).

Whether the different dryness determination value is achieved is determined by using the dryness determination value (ΔV) that is differently set by the groups divided during the actual dryness determination. It is for enabling estimating exact dryness consistently for all weights with due regard that the output characteristic of the humidity sensor is different according to the weight.

The method of controlling automatic drying in accordance with the present invention for determining dryness by using the principle is as follows.

Hereinafter, 'the dryness determination value set differently (ΔV)' is indicated divided into 'a first dryness determination value (ΔV1)' and 'a second dryness determination value (ΔV2)'.

Figure 9:
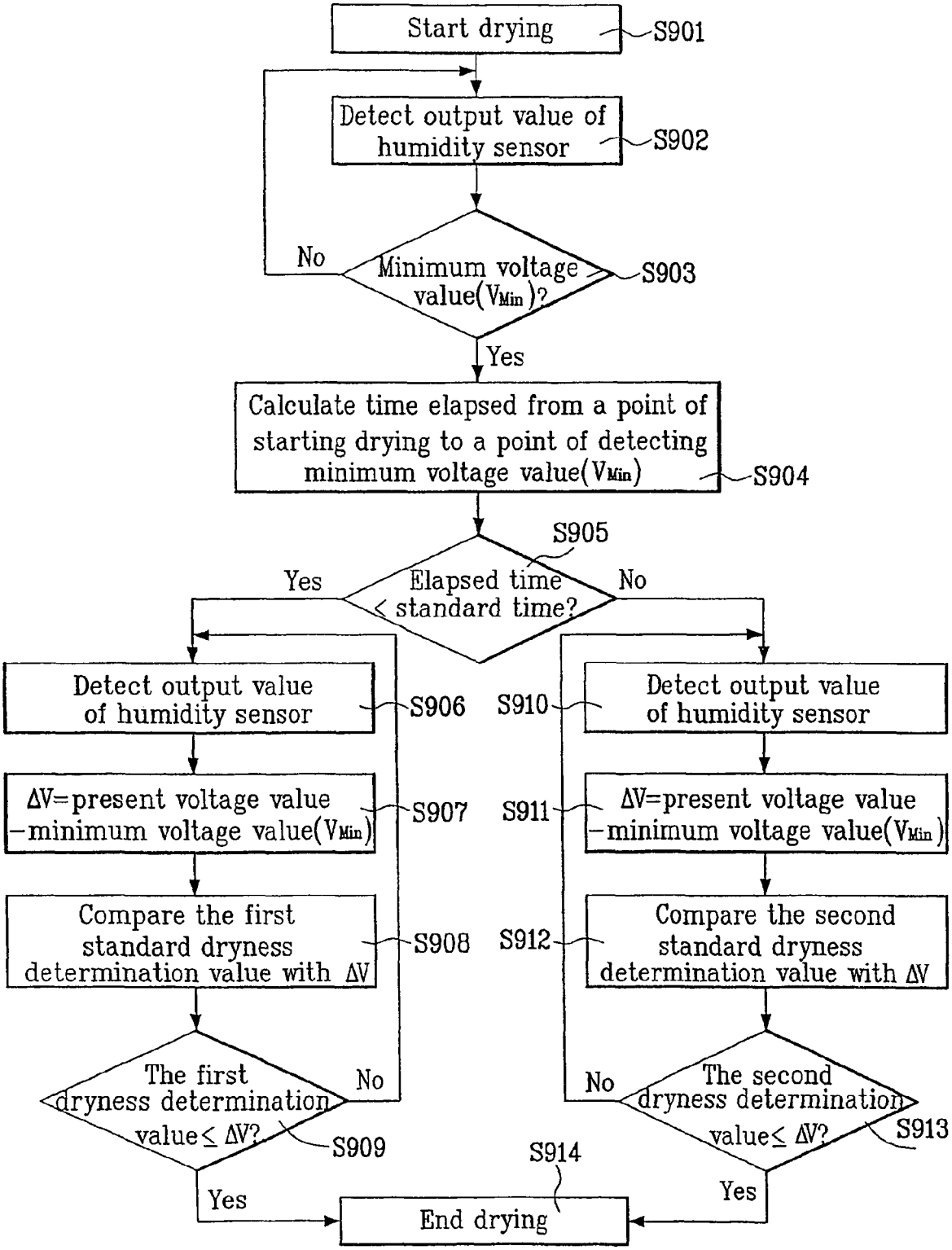
FIG. 9 illustrates a flow chart showing an automatic dry control method in accordance with the first embodiment of the present invention.

FIG. 9 illustrates a flow chart showing an automatic dry control method in accordance with the first embodiment of the present invention. The automatic dry control method in accordance with the first embodiment of the present invention includes a step of determining dryness by dividing the drying object to be dried on the basis of the time elapsed for outputting the minimum voltage value (Vmin) at the humidity sensor after the drying process is started, and applying different dryness determination value (ΔV).

First, when the drying process is started (S901), the micom reads (S902) the output value of the humidity sensor in ADC decimal data form. When the minimum voltage value (Vmin) is detected (S903) by determining whether the read output voltage value of the humidity sensor is the minimum voltage value (Vmin), the time elapsed from the point of starting the drying process to a point of calculating the minimum voltage value (Vmin) is calculated (S904).

Continuously, the calculated time elapsed is compared (S905) with the set standard time, and when the time elapsed till the point of calculating the minimum voltage value (Vmin) is shorter than the standard time, the weight is determined as the weight in the first group.

In other words, if the standard time is set at 4 min, the weight of the drying object is determined as the small amount (1 EA-1 Kg) when the time elapsed till the point of calculating the minimum voltage value (Vmin) is within 4 min (First group).

In contrast, when the time elapsed till the point of calculating the minimum voltage value (Vmin) is over 4 min, the drying object is determined as the middle and large amount (2 Kg-5 Kg) (Second group).

When the weight is determined as the small amount (First group) at the step of estimation, the output voltage value of the humidity sensor is inspected (S906) and the voltage change amount (ΔV) is calculated (S907) by calculating difference between the detected present voltage value and the minimum voltage value (Min) (ΔV=present voltage value-minimum voltage value (Vmin)). The first standard dryness determination value (ΔV1) is then compared with the calculated voltage change amount (ΔV) (S908).

At the step of comparison and determination (S909), when the calculated voltage change amount (ΔV) satisfies the first dryness determination value (ΔV1), the drying process is ended (S914). Otherwise, the drying process is continuously proceeded, and ended when the corresponding condition is satisfied by repeating the steps of calculating the voltage change amount (ΔV) by means of the inspected output value of the humidity sensor (S907) and comparing the voltage change amount (ΔV) with the first standard dryness determination value (ΔV1).

At the step of comparing the standard time with the time elapsed, when the weight is determine as the middle and large amount (Second group), the output voltage value of the humidity sensor is inspected (S910), and the voltage change amount (ΔV) is calculated by calculating difference between the inspected present voltage value and the minimum voltage value (Vmin) (S911) (ΔV=present voltage value-minimum voltage value (Vmin). And the second standard dryness determination value (ΔV2) is compared with the calculated voltage change amount (ΔV) (S912).

As a result of the comparison (S913), when the calculated voltage change amount satisfies the second standard dryness determination value (ΔV2), the drying process is ended (S914). Otherwise, the drying process is continuously proceeded, and ended when the corresponding condition is satisfied by repeating the steps of calculating the voltage change amount (ΔV) by means of the inspected output value of the humidity sensor (S907) and comparing the voltage change amount (ΔV) with the second standard dryness determination value (ΔV1).

The automatic dry control method in accordance with the first embodiment of the present invention for enabling to estimate dryness exactly for all weights includes the steps of dividing the drying object by means of the time elapsed till the point of calculating the minimum voltage value (Vmin) and applying different dryness determination value, not by applying a fixed dryness determination value without division according to the weight.

Figure 10:
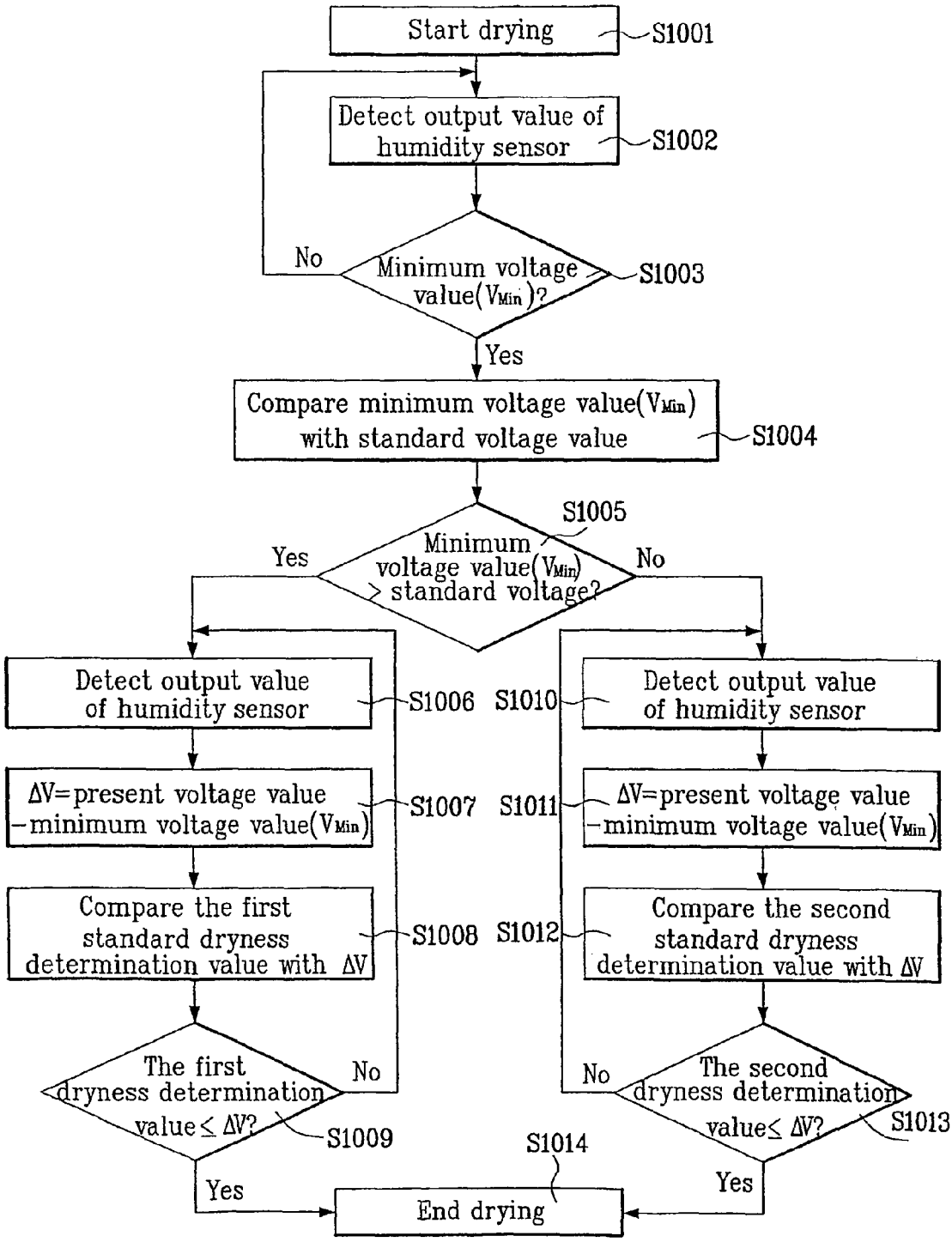
FIG. 10 illustrates a flow chart showing an automatic dry control method in accordance with the second embodiment of the present invention.

FIG. 10 illustrates a flow chart showing an automatic dry control method in accordance with the second embodiment of the present invention. The automatic dry control method includes a step of estimating dryness by dividing the drying object on the basis of the level of the minimum voltage value (Vmin) outputted from the humidity sensor after the drying process is started, and applying different dryness determination value (ΔV).

First, when the drying process is started (S1001), the micom reads (S1002) the output value of the humidity sensor in ADC decimal data form.

When the minimum voltage value (Vmin) is detected (S1003) by repeating the step of determining whether the read output voltage value of the humidity sensor is the minimum voltage value (Vmin), the minimum voltage value (Vmin) is compared with the standard voltage value (S1004).

Continuously, when it is determined (S1005) that the minimum voltage value (Vmin) is larger that the standard voltage value, the weight is determined as a weight included in the first group in above description.

In other words, if the standard voltage value is set at 0.5V, the weight of the drying object is determined as the small amount (1 EA-1 Kg) when the minimum voltage value (Vmin) is over 0.5V.

In contrast, the weight is determined as the middle and large amount (2 Kg-5 Kg) when the minimum voltage value is less than 0.5V (Second group).

When the weight is determined as the small amount (First group) at the step of determination, the output voltage value of the humidity sensor is calculated (S1006), and the voltage change amount (ΔV) is calculated (S1007) by calculating a difference between the inspected present voltage value and the minimum voltage value (Min) (ΔV=present voltage value−minimum voltage value (Vmin)). The first standard dryness determination value (ΔV1) is then compared with the calculated voltage change amount (ΔV) (S1008).

At the step of comparison and determination (S1009), when the calculated voltage change amount (ΔV) satisfies the first standard dryness determination value (ΔV1), the drying process is ended (S1004). Otherwise, the drying process is continuously proceeded, and ended when the corresponding condition is satisfied by repeating the steps of calculating the voltage change amount (ΔV) by means of the inspected output value of the humidity sensor (S1006) and comparing the voltage change amount (ΔV) with the first standard dryness determination value (ΔV1).

At the step of comparing the standard time with the time elapsed, when the weight is determined as the middle and large amount (Second group), the output voltage value of the humidity sensor is inspected (S1010), and the voltage change amount (ΔV) is calculated (S1011) by calculating difference between the inspected present voltage value and the minimum voltage value (Vmin) (ΔV=present voltage value−minimum voltage value (Vmin). The second standard dryness determination value (ΔV2) is then compared with the calculated voltage change amount (ΔV) (S1012).

As a result of the comparison (S1013), when the calculated voltage change amount (ΔV) satisfies the second standard dryness determination value (ΔV2), the drying process is ended (S1014). Otherwise, the drying process is continuously proceeded and ended when the corresponding condition is satisfied by repeating the steps of calculating the voltage change amount (ΔV) by means of the inspected output value of the humidity sensor (S1010) and comparing the voltage change amount (ΔV) with the second standard dryness determination value (ΔV1).

The automatic dry control method in accordance with the first embodiment of the present invention for enabling estimating exact dryness for all weights includes the steps of dividing the drying object by means of the time elapsed till the point of calculating the minimum voltage value (Vmin) and, applying different dryness determination value, not by applying a fixed dryness determination value without division according to the weight.

Figure 11:
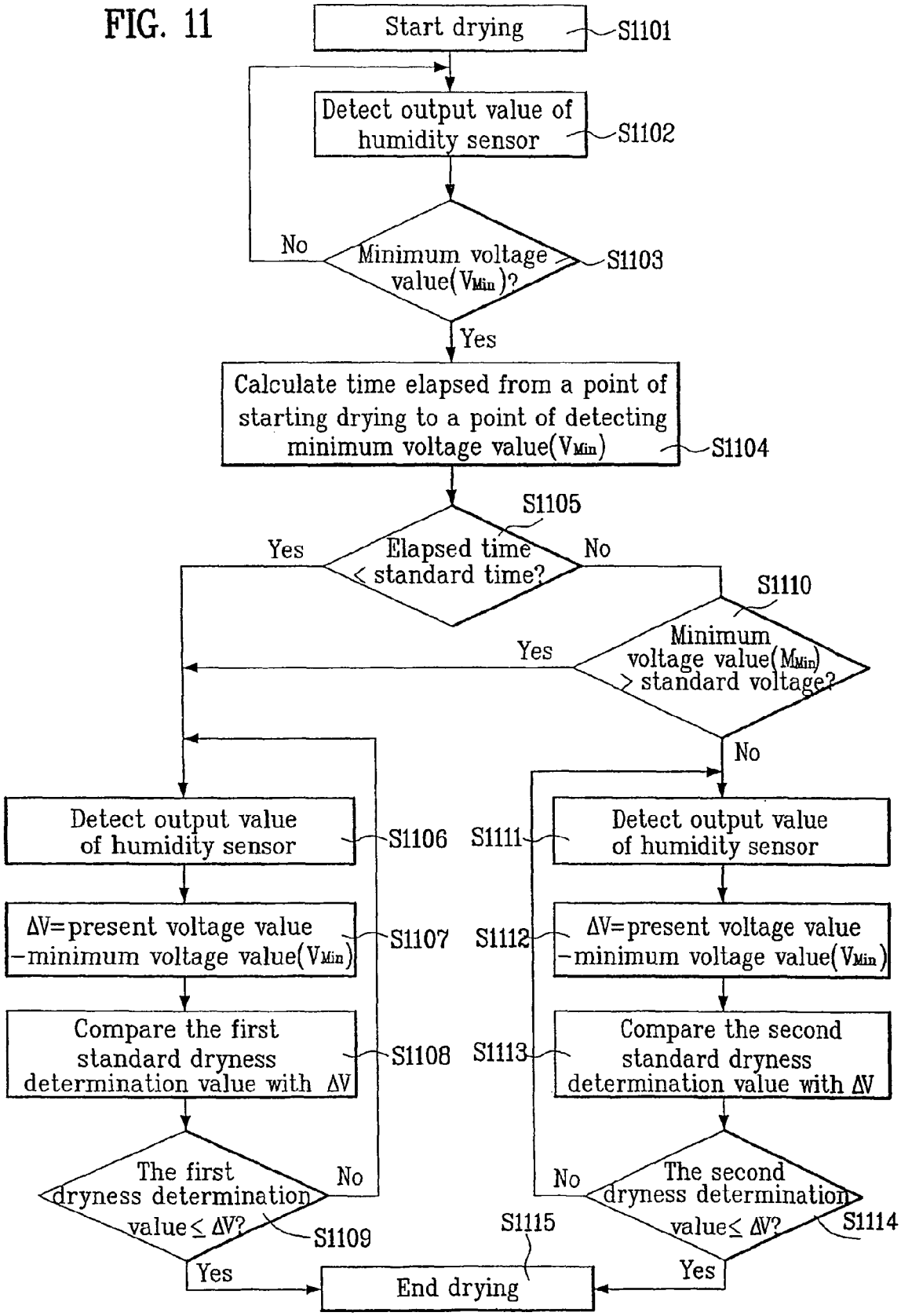
FIG. 11 illustrates a flow chart showing an automatic dry control method in accordance with the third embodiment of the present invention.

FIG. 11 illustrates a flow chart showing an automatic dry control method in accordance with the third embodiment of the present invention. The automatic dry control method includes a step of estimating dryness by dividing the drying object on the basis of the level of the minimum voltage value (Vmin) outputted from the humidity sensor after the drying process is started, and applying different dryness determination value (ΔV).

First, when the drying process is started (S1101), the micom reads (S1102) the output value of the humidity sensor in ADC decimal data form.

When the minimum voltage value (Vmin) is detected (S1103) by determining whether the output voltage value of the humidity sensor is the minimum voltage value (Vmin), the time elapsed from the point of starting the drying process to the point of detecting the minimum voltage value (Vmin) is calculated (S1104).

Continuously, the calculated elapsed time is compared with the standard time (S1105), and the weight is determined as a weight belonging to the first group in above description when the time elapsed till the point of detecting the minimum voltage value (Vmin) is shorter than the standard time.

In other words, if the standard time is set at 4 min, the weight of the drying object is determined as the small amount (1 EA-1 Kg) when the time elapsed before the point of detecting the minimum voltage value (Vmin) is within 4 min (First group).

In contrast, when the point of detecting the minimum voltage value (Vmin) is after 4 min is passed, the weight of the drying object is determined as the middle and large amount (2 Kg-5 Kg) (Second group).

When the weight is determined as the small amount (First group) at the step of estimation, the output voltage value of the humidity sensor is inspected (S1106) and the voltage change amount (ΔV) is calculated (S1107) by calculating a difference between the detected present voltage value and the minimum voltage value (Min) (ΔV=present voltage value−minimum voltage value (Vmin)). The first standard dryness determination value (ΔV1) is then compared with the calculated voltage change amount (ΔV) (S1108).

At the step of comparison and determination (S1109), when the calculated voltage change amount (ΔV) satisfies the first standard dryness determination value (ΔV1), the drying process is ended (S1115). Otherwise, the drying process is continuously proceeded and ended when the corresponding condition is satisfied by repeating the steps of calculating the voltage change amount (ΔV) by inspecting (S1106) the output value of the humidity sensor, and comparing the voltage change amount (ΔV) with the first standard dryness determination value (ΔV1).

When the weight is determined as the middle and large amount (Second group) at the step of comparing and determining (S1105) the standard time with the time elapsed, the step of comparing (S1110) the detected minimum voltage value (Vmin) with the standard voltage value is carried out, so as to increase exactness of the dryness determination when the actual weight is different from the weight divided for determining dryness, due to the difference of the percentage of water content according to the quality.

For example, even though the weight is judged as the middle and large amount (Second group) because the time elapsed is longer than the standard time that is set at the step of comparing and determining the standard time with the calculated elapsed time, the percentage of water content is low when the detected minimum voltage value (Vmin) is more than 0.5V, that is the standard voltage value. Therefore, it is for determining dryness by sorting the weight of the drying object as the small amount.

When the standard voltage value is judged to be larger than the minimum voltage value (Vmin) at the step of comparison and determination, the weight is judged to be a weight belonging to the First group. Accordingly, the step of S1116 is carried out, and dryness is determined by using the first standard dryness determination value (ΔV1).

When the minimum voltage value is judged to be smaller than the standard voltage value, the weight is judged to be middle and large amount.

In other words, when the standard voltage value is preset at 0.5V, the weight is judged to be the small amount (1 EA-1 Kg) (First group) when the minimum voltage value is more than 0.5V.

On the contrary, when the minimum voltage value is lower than 0.5V, the weight of the drying object is judged to be the middle and large amount (2 Kg-5 Kg) (Second group).

When the weight of the drying object is judged to be the middle and large amount at the step of S1110, the output voltage value of the humidity sensor is detected (S1111), and the voltage change amount is calculated by calculating the difference between the detected present voltage value and the minimum voltage value (Min) (S1112) (ΔV=present voltage value−minimum voltage value (Vmin). The second standard dryness determination value (ΔV2) is compared with the calculated voltage change amount (ΔV) (S1113).

At the step of comparison and judgment (S1114), when the calculated voltage change amount (ΔV) satisfies the second standard dryness determination value (ΔV2), the drying process is ended (S1115). Otherwise, the drying process is continuously proceeded, and ended when the corresponding condition is satisfied by repeating the steps of calculating the voltage change amount (ΔV) by inspecting the output value of the humidity sensor (S1111) and comparing the voltage change amount (ΔV) with the second standard dryness determination value (ΔV2).

The automatic dry control method in accordance with the third embodiment of the present invention is for dividing the drying object more precisely by applying the steps of using the time elapsed before the point of detecting the minimum voltage value (Vmin) and using the level of the detected minimum voltage value (Vmin).

The automatic drying apparatus in accordance with the present invention stabilizes the output characteristic by providing the humidity sensor at a location for minimizing the influence that changes the characteristic of the humidity sensor, and enables estimating exact dryness by dividing the drying object according to the time elapsed before the minimum voltage value is detected after the drying started, and the level of the minimum voltage value, and applying different dryness determination value.

Particularly, after the drying process is started, in case a step of dividing the drying object on the basis of the time elapsed before the minimum voltage value is detected and a step of dividing the drying object according to the level of the minimum voltage value are applied together, it is available to divide the drying object with due regard to percentage of water container according to the quality, not the physical weight, therefore the dryness is determined more precisely.

It is obvious that the automatic drying apparatus and the method for controlling the same in accordance with the present invention are applied to not only the combination drum type washer and drum type dryer, but also other forms of apparatus, such as a drying apparatus in a bigger size than the size described in the embodiment of the present invention with the same object as the exact dryness determination.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

As aforementioned, the automatic drying apparatus and the method for controlling the same in accordance with the present invention have effects as follows.

First, stabilized output characteristic is obtained by providing a humidity sensor for detecting humidity of the drying object at a location for minimizing the influence of changing the detection characteristic.

Second, a structural margin is secured enough by providing the humidity sensor, without changing the flow of circulating air and the structure of the duct.

Third, estimating exact dryness is available by using not many but just one humidity sensor.

Fourth, the drying object is divided on the basis of the time elapsed before the point that the output voltage value becomes the minimum voltage value, and drying with consistency is enabled for all weights by applying different dryness determination value.

Fifth, the drying object is divided on the basis of the level of the minimum output voltage value of the humidity sensor, and drying with consistency is enabled for all weights by applying different dryness determination value.

Sixth, estimating exact dryness is enabled by applying both steps of dividing the drying object on the basis of the time elapsed before the point that the output voltage value of the humidity sensor becomes the minimum, and on the basis of the level of the minimum output voltage value of the humidity sensor.

What is claimed is:

1. A controlling method of an automatic drying apparatus, comprising:

reading an output voltage of a humidity sensor after a drying process is started;

classifying a load that includes one or more drying objects into a first group or a second group based on a weight of the load, wherein a load classified into the first group is assigned a first dryness determination value and a load classified in the second group has a second dryness determination value different from the first dryness determination value, the loads in the first and second groups having different weights, and wherein the weight of the load is classified into the first group or second group is determined based on at least one of:

a) a time elapsed from a starting point of the drying process to a point where an output voltage value of the humidity sensor at least substantially equals a minimum value, or b) a level of the minimum voltage value output from the humidity sensor after the drying is started;

calculating a difference between a present voltage value and the minimum voltage value in a) or b) output from the humidity sensor;

determining a voltage change amount based on a result of said calculation;

comparing the voltage change amount with the first dryness determination value or second dryness determination value to determine a dryness of the load, the voltage change amount compared to the first dryness determination value when the load is classified into the first group and compared to the second dryness determination value when the load is classified into the second group; and finishing the drying process when the voltage change amount at least substantially equals or falls within a range that includes the first dryness determination value or the second dryness determination value corresponding to the first group or the second group into which the load is classified, wherein at least one of said reading, classifying, calculating, determining, comparing or finishing is performed by a controller.

2. The controlling method of the automatic drying apparatus of claim 1, wherein the load is classified based on a time elapsed from a starting point of the drying process to a point where the output voltage value of the humidity sensor at least substantially equals the minimum value.

3. The controlling method of the automatic drying apparatus of claim 1, wherein the load is classified based on a level of the minimum voltage value outputted from the humidity sensor after the drying process is started.

4. The controlling method of the automatic drying apparatus of claim 1, wherein the load is classified based on:

a time elapsed from a starting point of the drying process to a point where the output voltage value of the humidity sensor at least substantially equals the minimum value; and a level of the minimum voltage value outputted from the humidity sensor after the drying process is started.

5. The controlling method of the automatic drying apparatus of claim 2, wherein the load is classified into the first group or the second group by:

comparing said time elapsed to a standard time, and classifying the load into the first group or the second group based on a result of the comparison of said time to the standard time.

6. The controlling method of the automatic drying apparatus of claim 5, wherein the load is classified into the first group when said time is less than the standard time and is classified into the second group when said time is greater than the standard time wherein a load classified into the first group has a weight less than a load classified into the second group.

7. The controlling method of the automatic drying apparatus of claim 5, wherein the voltage change amount ($\Delta V$) for a load classified in the first group is smaller than a voltage change amount ($\Delta V$) for a load classified in the second group.

8. The controlling method of the automatic drying apparatus of claim 5, wherein the load is classified into the first group when said time is less than the standard time and is classified into the second group when said time is greater than the standard time, and wherein a load is classified into the first group has a weight less than a load classified into the second group.

9. The controlling method of an automatic drying apparatus of claim 3, wherein the load is classified by:

comparing the detected minimum voltage value (Vmin) with a preset standard voltage value, and classifying the load into the first group or the second group based on a result of the comparison of the minimum voltage value with the preset standard voltage value.

10. The controlling method of the automatic drying apparatus of claim 9, wherein a load classified into the first group has a weight less than a load classified into the second group.

* * * * *